US012007194B2

(12) United States Patent
Kung et al.

(10) Patent No.: US 12,007,194 B2
(45) Date of Patent: Jun. 11, 2024

(54) TOY GUN STRUCTURE AND PNEUMATIC VALVE MECHANISM THEREOF

(71) Applicant: VEGA FORCE INTERNATIONAL CORP., Taoyuan (TW)

(72) Inventors: Shih-Che Kung, Taoyuan (TW); Wei-Hung Chung, Taoyuan (TW)

(73) Assignee: VEGA FORCE INTERNATIONAL CORP., Taoyuan (TW)

( * ) Notice: Subject to any disclaimer, the term of this patent is extended or adjusted under 35 U.S.C. 154(b) by 133 days.

(21) Appl. No.: 17/970,529

(22) Filed: Oct. 20, 2022

(65) Prior Publication Data

US 2024/0077278 A1 Mar. 7, 2024

(30) Foreign Application Priority Data

Sep. 1, 2022 (TW) ..... 111209505

(51) Int. Cl.
*F41B 11/89* (2013.01)
*F41B 7/08* (2006.01)
*F41B 11/723* (2013.01)

(52) U.S. Cl.
CPC ..... *F41B 11/89* (2013.01); *F41B 7/08* (2013.01); *F41B 11/723* (2013.01)

(58) Field of Classification Search
CPC ..... F41B 11/89; F41B 11/723; F41C 27/06
USPC ..... 42/105
See application file for complete search history.

(56) References Cited

U.S. PATENT DOCUMENTS 3,279,114 A * 10/1966 Lewis ..... F41C 27/06 42/105

* cited by examiner

*Primary Examiner* — Jonathan C Weber
(74) *Attorney, Agent, or Firm* — Chun-Ming Shih; HDLS IPR SERVICES

(57) ABSTRACT

A pneumatic valve mechanism disposed in a toy gun includes a trigger with an action bar, a driving assembly and a firing assembly. The driving assembly is disposed pivotally on the toy gun and linked with a shaft to pivot by the action bar. The firing assembly has a pushing portion and a triggering portion disposed oppositely to the pushing portion. The triggering portion makes the firing assembly reciprocate by an elastic member. The shaft is disposed with a pushing surface. The pushing surface pushes the triggering portion of the firing assembly when the shaft rotates pivotally.

14 Claims, 4 Drawing Sheets

TOY GUN STRUCTURE AND PNEUMATIC VALVE MECHANISM THEREOF

BACKGROUND

Technical Field

The disclosure relates to a toy gun, particularly to a toy gun structure and a pneumatic valve mechanism thereof.

Description of Related Art

In order to adopt more types of simulated military weapons during a game, related-art toy guns used in survival games adopt not only commonly known airsoft pellets or paintballs as toy bullets to be fired, but also a toy bullet structure simulating a grenade. Such a grenade attaches a bullet shell made of soft rubber on a small valve seat filled with gas, and a switch of the valve seat is triggered to make the filled gas rush toward the bullet shell to be shot out when the toy gun is fired. The bullet shell may also be filled with multiple airsoft pellets or paintballs for the effect of scattering shoot.

However, the firing mechanism of a related-art toy gun is located adjacent to the upper position of the trigger or uses some complicated structural designs to be corresponding to different simulated guns. A real gun such as a grenade gun usually cannot adopt designs of other related-art simulated guns directly, so a structural design, which can match different simulated exterior to adjust and shorten the firing stroke and occupy a smaller space, is required.

In view of this, the inventors have devoted themselves to the above-mentioned related art, researched intensively and cooperated with the application of science to try to solve the above-mentioned problems. Finally, the invention which is reasonable and effective to overcome the above drawbacks is provided.

SUMMARY

An object of the disclosure is to provide a toy gun structure and a pneumatic valve mechanism of a toy gun thereof, which use structural designs, such as a pivoting angle and a pushing bevel, to accurately control the displacement required in the mechanical operation so as to save the occupied space.

Another object of the disclosure is to provide a toy gun structure and a pneumatic valve mechanism of a toy gun thereof, which use an action bar to drive. The length of the action bar may be corresponding to the distance between the bullet room and the trigger depending upon the exterior of a gun to be simulated, so as to be suitable for exteriors of various types of simulated guns.

To accomplish the above objects, the disclosure provides a pneumatic valve mechanism disposed in a toy gun, which includes a trigger with an action bar, a driving assembly and a firing assembly. The driving assembly is disposed pivotally on the toy gun and linked with a shaft to pivot by the action bar. The firing assembly has a pushing portion and a triggering portion disposed oppositely to the pushing portion. The triggering portion makes the firing assembly move reciprocally by an elastic member. The shaft is disposed with a pushing surface. The pushing surface pushes the triggering portion of the firing assembly when the shaft rotates pivotally.

To accomplish the above objects, the disclosure provides a toy gun structure, which includes a launcher and a pneumatic valve mechanism. The launcher has a barrel with a loading space. The pneumatic valve mechanism is disposed behind the loading space of the barrel and includes a trigger with an action bar, a driving assembly and a firing assembly. The driving assembly is disposed pivotally on the barrel and linked with a shaft to pivot by the action bar. The firing assembly has a pushing portion and a triggering portion disposed oppositely to the pushing portion. The triggering portion makes the firing assembly move reciprocally toward the loading space by an elastic member. The shaft is disposed with a pushing surface. The pushing surface pushes the triggering portion of the firing assembly toward the loading space when the shaft rotates pivotally.

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
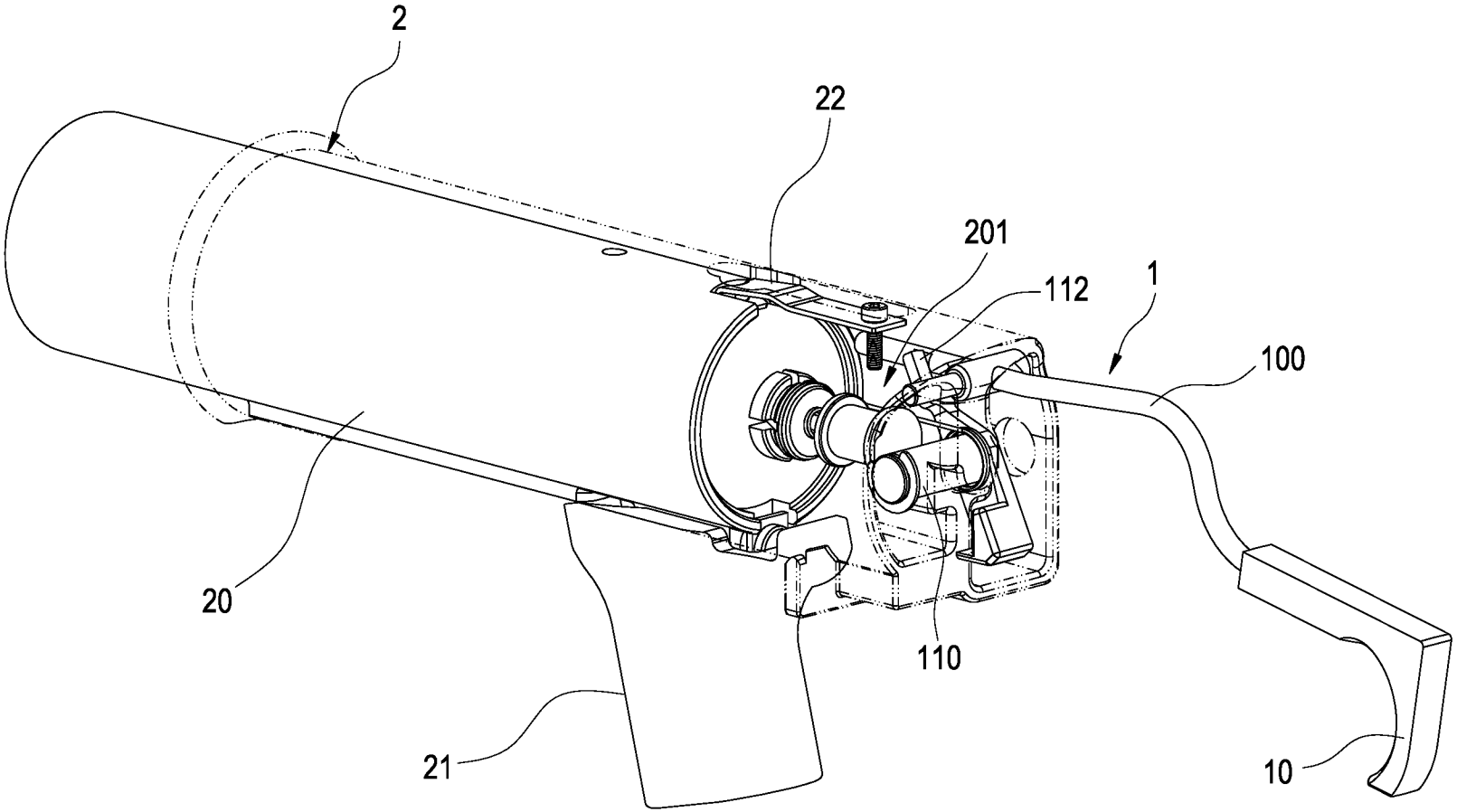
FIG. 1 is an assembled schematic view of the disclosure.
Figure 2:
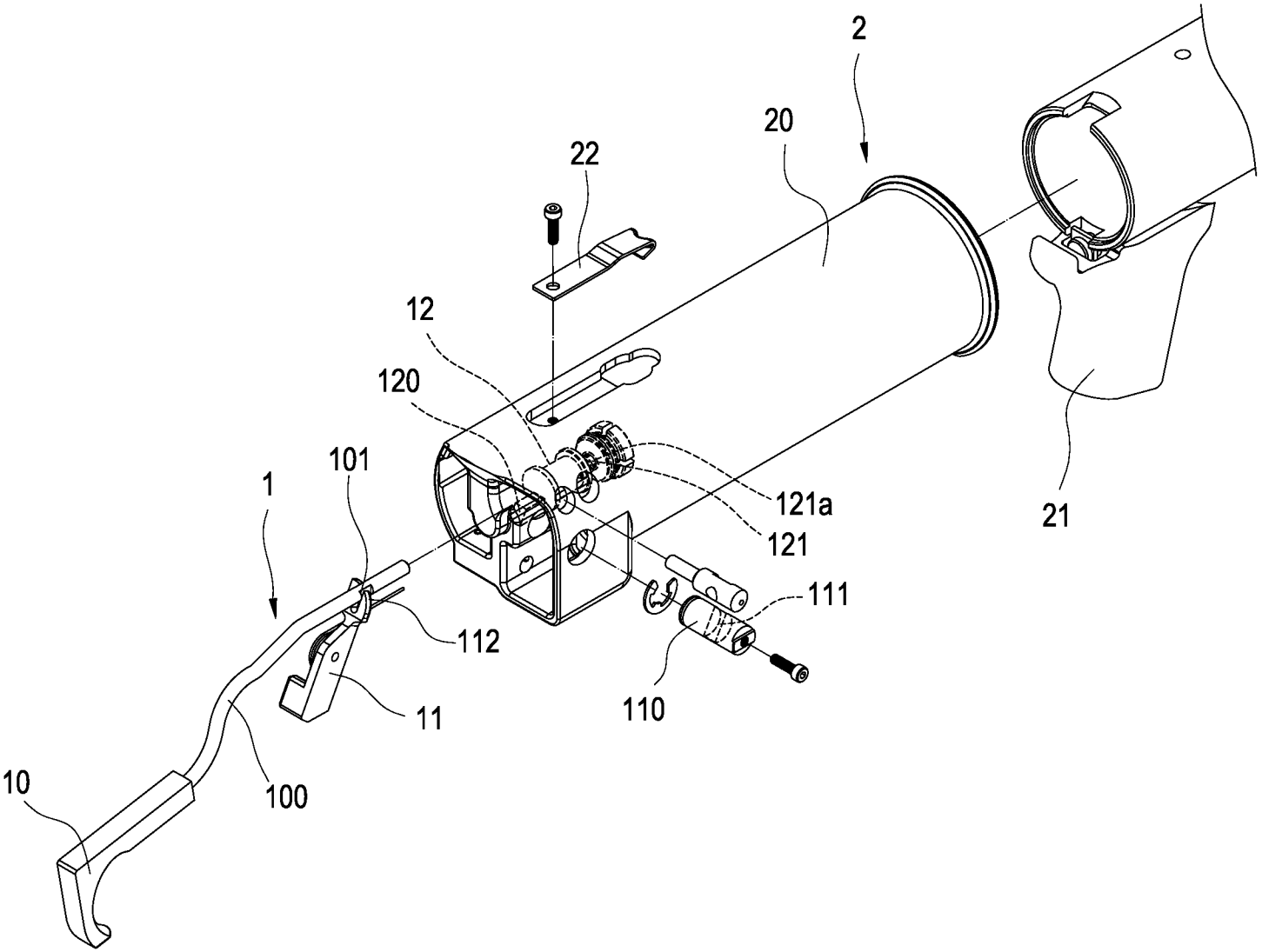
FIG. 2 is an exploded schematic view of the disclosure from another viewpoint.
Figure 3:
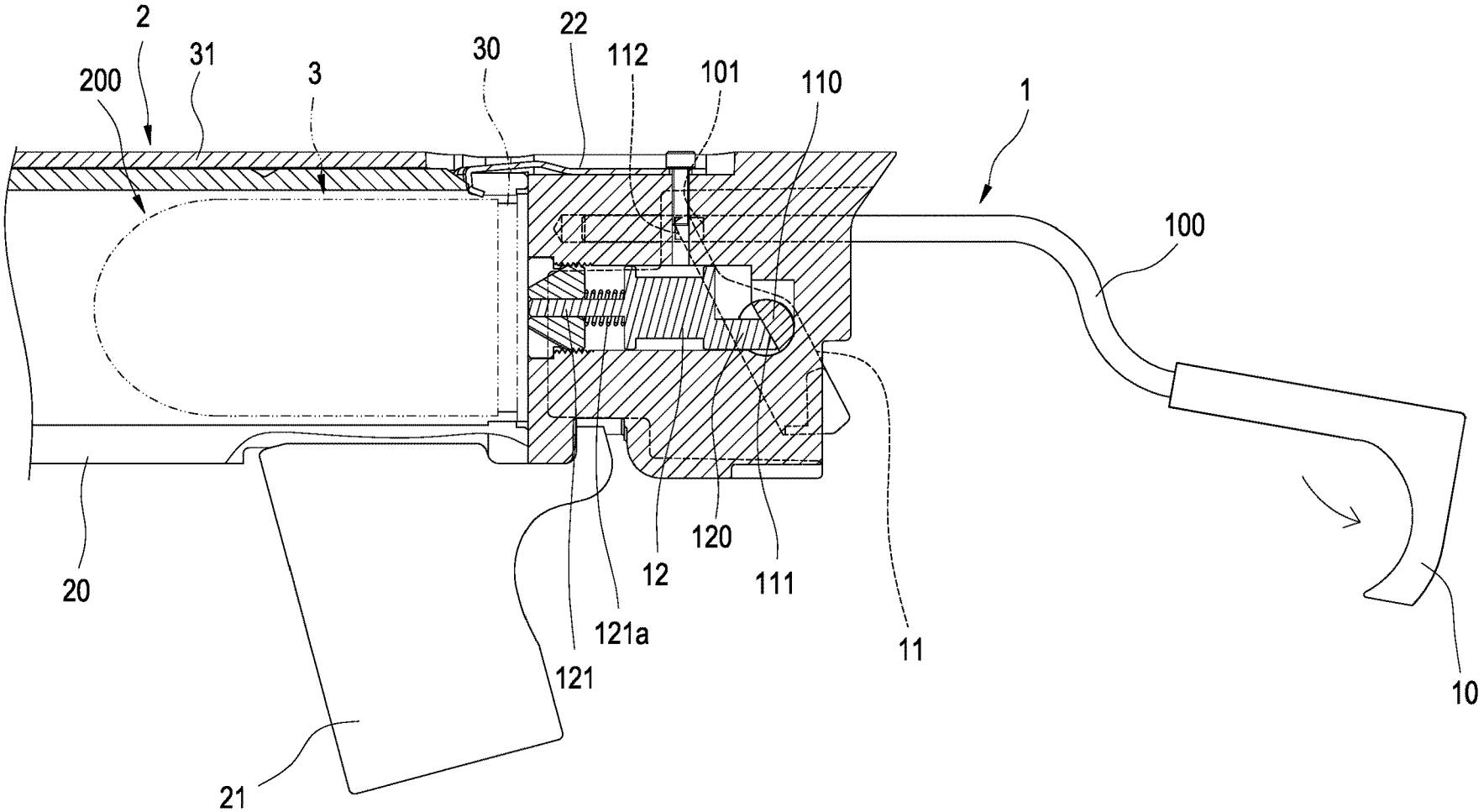
FIG. 3 is a cross-sectional schematic view of operation of the disclosure before firing.

Please refer to FIGS. 1 and 2, which are an assembled schematic view and an exploded schematic view from another viewpoint of the disclosure. The disclosure provides a toy gun structure and a pneumatic valve mechanism of toy gun thereof. The pneumatic valve mechanism 1 may be disposed in a launcher 2 of a toy gun. The launcher 2 may be a simulated gun such as, but not limited to, a shotgun, a grenade gun or a grenade launcher. As shown in FIG. 3, the launcher 2 may have a barrel 20. There is a loading space 200 in the barrel 20 for allowing a toy bullet 3 to be placed in the loading space 200 to be fired. The pneumatic valve mechanism 1 is disposed behind the loading space 200, for example, an installing position 201 (as shown in FIG. 1) is formed behind the loading space 200 for the pneumatic valve mechanism 1 to be disposed. The pneumatic valve mechanism 1 includes a trigger 10, a driving assembly 11 linked by the trigger 10 and a firing assembly 12 driven by the driving assembly 11.

The trigger 10 may be disposed at a proper position of the launcher 2 (not shown in figures), its actual position may depend upon the position of the toy gun to be simulated. The trigger 10 may have an action bar 100 extended toward the rear of the loading space 200. The extended length of the action bar 10 may make the trigger 10 be disposed at a corresponding position of a corresponding simulated gun to facilitate performing the simulation design of the exterior of a toy gun. When the trigger 10 is pulled (triggered), the action bar 100 may be linked by the trigger 100 to move.

The driving assembly 11 is disposed pivotally on the barrel 20 and linked with a shaft 110 to pivot. As shown in FIGS. 2 and 3, the shaft 110 is disposed with a pushing surface 111 pushing the firing assembly 12. The pushing surface 111 may be a bevel and formed by inward denting from a cylindrical surface of the shaft 110 (namely, by inward denting a cylindrical surface of the shaft 110). The driving assembly 11 is disposed protrusively with a fork portion 112 to link the action bar 100. In the shown embodiment of the disclosure, the action bar 100 may be dented with a corresponding recess 101 for the fork portion 112 clamping from bottom to top and moving with the action bar 100. In addition, the linking manner of the driving assembly 11 and the action bar 100 is not limited to the abovementioned one.

The firing assembly 12 has a pushing portion 120 extended toward the pushing surface 11 and a triggering portion 121 disposed oppositely to the pushing portion 120 to push toward the loading space 200. The triggering portion 121 makes the firing assembly 12 move reciprocally toward the loading space 200 through being abutted by an elastic member 121*a*. That is, as shown in FIG. 4, when the shaft 110 of the driving assembly 11 pivots, the pushing surface 111 may exert a force on the pushing portion 120 to push the firing assembly 12 toward the loading space 200 so as to make the triggering portion 121 of the firing assembly 12 press the valve seat 30 of the toy bullet 3 to generate air pressure to fire the warhead 31 from the barrel 20.

Furthermore, after the above firing action, the firing assembly is pressed by the elastic member 121*a* to return to the initial position for allowing the pushing portion 120 to be flatly attached with the pushing surface 111 of the driving assembly 11.

As a result, by the above structure, the pneumatic valve mechanism of the toy gun may be obtained.

Figure 4:
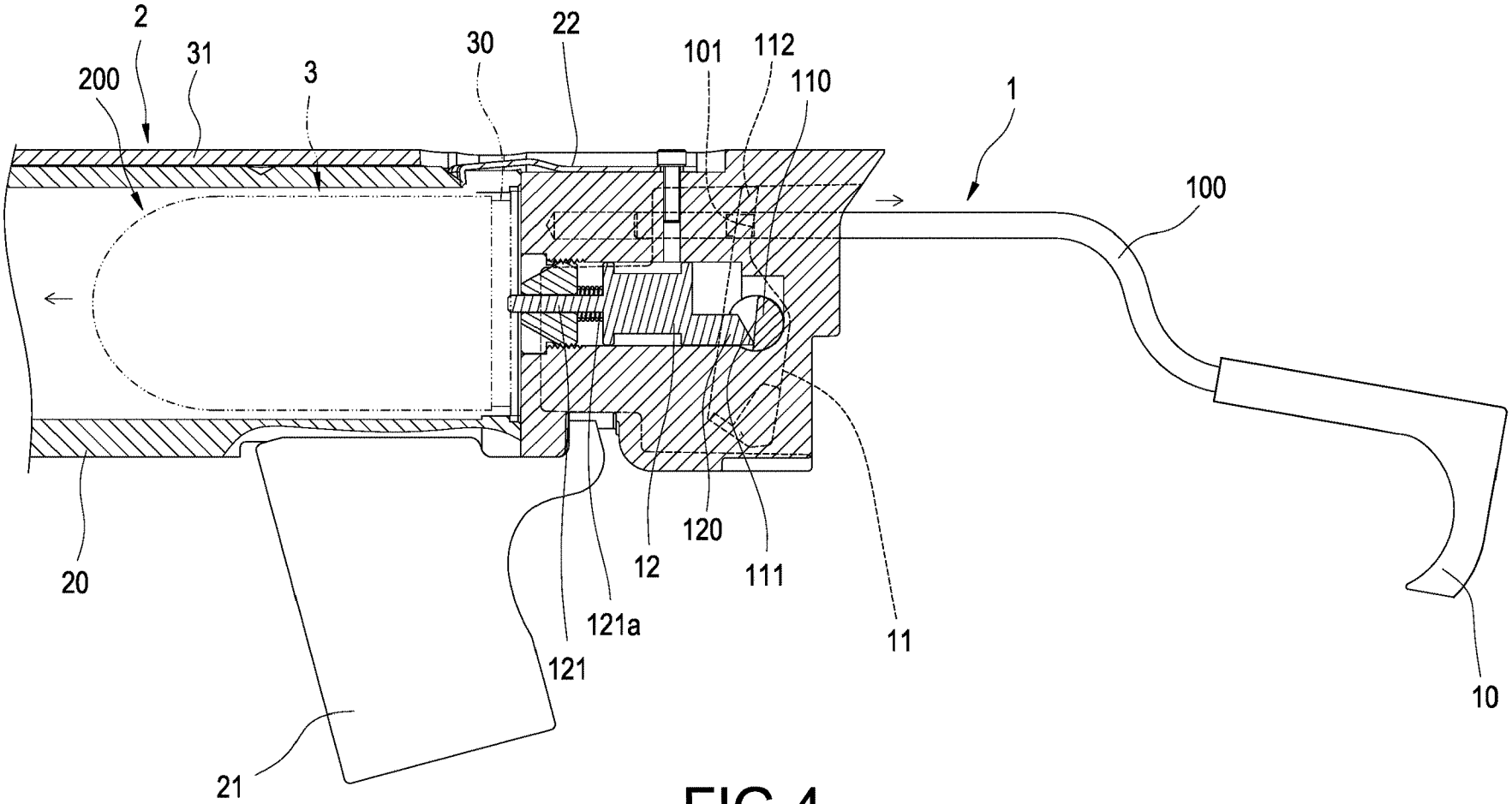
FIG. 4 is a cross-sectional schematic view of operation of the disclosure after firing.

Thus, as shown in FIGS. 3 and 4, the toy bullet 3 may utilize a loading manner of a simulated gun to be placed in the loading space 200 of the launcher 2. The launcher 2 may have an auxiliary handle 21 disposed under the barrel 20 (such as for left-hand holding) for simulation. The toy bullet 3 has a valve seat 30 and a warhead 31 mounted on the valve seat 30. The launcher 2 may be disposed with a latch 22 on the barrel 20 for clamping the toy bullet 3 to fix the valve seat 30 of the toy bullet 3 in the loading space 200 to prevent the valve seat 30 from being shot together. In addition, the warhead 31 of the toy bullet 3 may be made of soft rubber, and its outline may simulate a real shape or other shapes. The inside of the warhead 31 may be further filled with airsoft pellets to accomplish the effect of scattering shoot. The toy bullet 3 is an exemplar description, here is not intended to be limiting.

Accordingly, when a user pulls the trigger 10, the action bar 100 is drawn by the trigger 10 to link the fork portion 112 of the driving assembly 11 to make the driving assembly 11 pivot by the shaft 110 so as to make the pushing surface 111 push the firing assembly 12 toward the loading space 200. At the same time, as shown in FIG. 4, the triggering portion 121 of the firing assembly 12 presses the valve seat 30 of the toy bullet 3 to generate air pressure so as to fire the warhead 31 from the barrel 20 through the air pressure, and the valve seat 30 is kept in the loading space 200 by the latch 22 so as to allow a user to replace a new toy bullet 3 and then be ready to re-fire again.

Thus, the toy gun structure and the pneumatic valve mechanism of the toy gun thereof of the disclosure utilize the pivoting of the shaft 110 of the driving assembly 11 to make the pushing surface 111 push the firing assembly 12 toward the loading space 200 in the rotational space range of the shaft 110, so the overall linking mechanism and the required space are small. Also, the pivoting angle of the shaft 110 and the changed position of the pushing surface 111 may be used to accurately control the required displacement of the firing assembly 12, so the required occupied space may be further saved so as to match exteriors of different simulated guns. In addition, the driving assembly 11 may be driven by the action bar 100 of the trigger 10 and the length of the action bar 100 may be corresponding to the distance between the bullet room and the trigger depending upon the exterior of the toy gun to be simulated to be suitable for exteriors of various types of simulated guns.

While this disclosure has been described by means of specific embodiments, numerous modifications and variations could be made thereto by those skilled in the art without departing from the scope and spirit of this disclosure set forth in the claims.

What is claimed is:

1. A pneumatic valve mechanism, disposed in a toy gun, the pneumatic valve mechanism comprising:

a trigger, comprising an action bar;

a driving assembly, disposed pivotally on the toy gun, and linked with a shaft to pivot by the action bar; and a firing assembly, comprising a pushing portion and a triggering portion disposed oppositely to the pushing portion, and the triggering portion configured to make the firing assembly move reciprocally by an elastic member;

wherein the shaft comprises a pushing surface, and the pushing surface is configured to push the triggering portion of the firing assembly when the shaft rotates pivotally.

2. The pneumatic valve mechanism of claim 1, wherein the pushing surface is a bevel.

3. The pneumatic valve mechanism of claim 1, wherein the pushing surface is formed by inward denting from a cylindrical surface of the shaft.

4. The pneumatic valve mechanism of claim 3, wherein the firing assembly is pressed by the elastic member to make the pushing portion be flatly attached with the pushing surface.

5. The pneumatic valve mechanism of claim 1, wherein the driving assembly comprises a fork portion disposed protrusively thereon to be linked with the action bar.

6. The pneumatic valve mechanism of claim 5, wherein the action bar comprises a recess disposed concavely thereon, and the fork portion is configured to clamp the recess.

7. A toy gun structure comprising:

a launcher, comprising a barrel with a loading space; and a pneumatic valve mechanism, disposed behind the loading space of the barrel, and comprising a trigger, comprising an action bar;

a driving assembly, disposed pivotally on the barrel, and linked with a shaft to pivot by the action bar; and a firing assembly, comprising a pushing portion and a triggering portion disposed oppositely to the pushing portion, and the triggering portion configured to make the firing assembly move reciprocally toward the loading space by an elastic member;

wherein the shaft comprises a pushing surface, the pushing surface is configured to push the triggering portion of the firing assembly toward the loading space when the shaft rotates pivotally.

8. The toy gun structure of claim 7, wherein the barrel comprises an installing position located behind the loading space for the pneumatic valve mechanism to be disposed.

9. The toy gun structure of claim 7, wherein a latch is disposed on the barrel.

10. The toy gun structure of claim 7, wherein the pushing surface is a bevel.

11. The toy gun structure of claim 7, wherein the pushing surface is formed by inward denting from a cylindrical surface of the shaft.

12. The toy gun structure of claim 11, wherein the firing assembly is pressed by the elastic member to make the pushing portion be flatly attached with the pushing surface.

13. The toy gun structure of claim 7, wherein the driving assembly comprises a fork portion disposed protrusively thereon to be linked with the action bar.

14. The toy gun structure of claim 13, wherein the action bar comprises a recess disposed concavely thereon, and the fork portion is configured to clamp the recess.

* * * * *